US009074792B2

(12) United States Patent
Ellingwood et al.

(10) Patent No.: US 9,074,792 B2
(45) Date of Patent: Jul. 7, 2015

(54) MULTIPLE-RING HEAT EXCHANGER

(75) Inventors: Christopher John Ellingwood, Tannersville, PA (US); Abdel H. Shidfar, Aberdeen, NJ (US); Walter George Rykowski, Easton, PA (US); Christopher Russell Hurst, Stroudsburg, PA (US); Douglas James Smith, Stroudsburg, PA (US); James Albert Hall, Tannersville, PA (US)

(73) Assignee: HARSCO CORPORATION, Camp Hill, PA (US)

( * ) Notice: Subject to any disclaimer, the term of this patent is extended or adjusted under 35 U.S.C. 154(b) by 1137 days.

(21) Appl. No.: 13/034,738

(22) Filed: Feb. 25, 2011

(65) Prior Publication Data

US 2011/0203781 A1 Aug. 25, 2011

Related U.S. Application Data

(60) Provisional application No. 61/307,932, filed on Feb. 25, 2010.

(51) Int. Cl.

| | |
|---|---|
| ***F28F 9/22*** | (2006.01) |
| ***F28D 7/10*** | (2006.01) |
| ***F28F 9/02*** | (2006.01) |
| ***F24B 1/06*** | (2006.01) |
| ***F24H 1/40*** | (2006.01) |
| *F28D 7/16* | (2006.01) |

(52) U.S. Cl.

CPC ..... *F24H 1/403* (2013.01); *F28D 7/1676* (2013.01)

(58) Field of Classification Search

CPC ..... F28D 1/05316; F28D 1/05358; F28D 7/1676; F28F 9/22

USPC ..... 165/159, 157, 168, 169; 122/15.1, 18.1, 122/235.17, 235.15

See application file for complete search history.

(56) References Cited

U.S. PATENT DOCUMENTS

| | | | | |
|---|---|---|---|---|
| 3,884,297 | A * | 5/1975 | Fegraus et al. | 165/145 |
| 4,261,299 | A | 4/1981 | Marran | |
| 4,938,204 | A | 7/1990 | Adams | |
| 5,186,249 | A * | 2/1993 | Bhatti et al. | 165/174 |
| 5,687,678 | A | 11/1997 | Suchomel et al. | |
| 2003/0116306 | A1 * | 6/2003 | Besik | 165/109.1 |
| 2007/0199683 | A1 * | 8/2007 | Emrich | 165/125 |
| 2008/0216772 | A1 * | 9/2008 | Gordon et al. | 122/18.3 |
| 2010/0051228 | A1 * | 3/2010 | Han | 165/41 |

* cited by examiner

*Primary Examiner* — M. Alexandra Elve
*Assistant Examiner* — Dawit Muluneh
(74) *Attorney, Agent, or Firm* — Withers Bergman LLP; Alan D. Gardner

(57) ABSTRACT

The heat exchanger with a radial heat source has a first header, a second header, first tubes and second tubes. The first header is configured to allow liquid to enter and exit the heat exchanger. The second header is spaced from the first header and has at least one lower baffle provided therein. The first tubes extend from the first header to the second header, with the first tubes being spaced proximate to the radial heat source. The second tubes extend from the first header to the second header, with the second tubes being spaced from the radial heat source a greater distance than the first tubes. An enhancement device may be positioned in respective tubes of the first tubes to create a water vortex in the first tubes wherein boiling of the water in the first tubes is prevented.

24 Claims, 13 Drawing Sheets

MULTIPLE-RING HEAT EXCHANGER

FIELD OF THE INVENTION

The present invention is directed to heat exchangers, and in particular to radially fired heat exchangers with multiple rings of tubes.

BACKGROUND OF THE INVENTION

For many years, commercial water heaters have been constructed using burners and heat exchanger water flow tubing. Commercial water heaters must be capable of producing and heating water with tens of thousands, and even hundreds of thousands, of BTUs. Further, in modern commercial applications, the emission standards for water heaters are strictly regulated. Complete burning of fuel is controlled so that hydrocarbon emissions are very low. In many existing commercial water heaters, natural gas is burned in an environment of forced air.

Many direct-fired, commercial water heating systems are known in the industry. One commercially available system, disclosed in U.S. Pat. No. 4,261,299, utilizes a horizontal combustion chamber around which water flows through a double-walled shell that is wound repeatedly around the combustion chamber with spaces between each successive winding to accommodate a countercurrent flow of exhaust gases.

Another system, disclosed in U.S. Pat. No. 4,938,204, utilizes a dual tank design. One tank contains the primary heat exchanger in which a horizontally mounted conventional burner heats water flowing through two-pass, U-bend fire tubes. Exhaust gases that exit the primary heat exchanger at 350 degrees Fahrenheit to 400 degrees Fahrenheit are routed to a secondary heat exchanger where they are passed countercurrent to ambient makeup water to preheat the water before entering the primary exchanger. Makeup air is preheated to over 200 degrees Fahrenheit by passing it through ductwork which surrounds the exhaust gases exiting the secondary exchanger.

Some of the newer prior art systems utilize primary exchanger sections comprising a vertically-disposed, radially-directed, cylindrical burner in combination with a plurality of fixed length, copper-finned tubes arranged vertically around the burner. Water flows through the tubes, which are typically connected to headers located above and below the combustion zone, either in single or double-pass configurations. In some heaters, the copper-finned tubes are intermeshed and completely surround the burner to enhance heat transfer. Difficulties have been experienced with these heaters, however, because of the length of the tubing required to allow for effective heat exchange and the limited amount of expansion or contraction that can be accommodated with the fixed tube design.

U.S. Pat. No. 5,687,678 discloses a commercial water heater apparatus, including a housing, a radial-fired burner within the housing, a single continuous, multiple-loop, finned coil tubing heat exchanger for circulating water around the burner, having at least a first set of inner coils forming a coil trough therebetween and a second set of outer coils nested within the coil trough formed by the inner set of coils, the outer set of coils forming a second coil trough around the exterior thereof, and a coil baffle interposed in the second exterior trough for deflecting heat adjacent to the second set of coils.

Highly efficient transfer of heat energy from the burned fuel to the water has been an object of commercial water heater design for a number of years. In accomplishing the high efficiency heat transfer from the combustion products to the circulated water, in many systems a certain amount of water vapor in the combustion gases will be condensed from the combustion gas. This condensate is typically highly acidic, having PH values in the range of between 2 to 5, depending upon the chemical constituents of halogenated hydrocarbon in the natural gas and air mixture. For example, increased halogen content of the natural gas and air mixture can greatly increase the acidity of the condensate. Therefore, various commercial water heaters are simply designed to operate below the efficiency at which large quantities of condensate are likely to form so that the acidic vapors are discharged in vapor form in high temperature exhaust gas.

Notwithstanding the systems disclosed in the prior art, it would be beneficial to have a radial-fired heat exchanging apparatus which has a compact configuration and which can quickly and efficiently transfer heat to water passing through the tubes.

SUMMARY OF THE INVENTION

An exemplary embodiment is directed to a heat exchanger having a radial heat source. The heat exchanger has a first header, a second header, first tubes and second tubes. The first header is configured to allow liquid to enter and exit the heat exchanger. The second header is spaced from the first header and has at least one lower baffle provided therein. The first tubes extend from the first header to the second header, with the first tubes being spaced proximate to the redial heat source. The second tubes extend from the first header to the second header, with the second tubes being spaced from the radial heat source a greater distance than the first tubes. Liquid with the lowest velocity enters the second header through the second tubes proximate the lower baffle to provide for the shortest return path through the first tubes to equalize the flow rate through each first tube.

The exemplary embodiment above may further include the first header has an inlet pipe which allows liquid to flow into an outer chamber of the first header, the second tubes being connected to the outer chamber to allow the liquid to flow from the outer chamber through the second tubes; and an outlet pipe which extends from an inner chamber of the first header to allow liquid to flow from the inner chamber out of the heat exchanger, the first tubes being connected to the inner chamber to allow the liquid to flow from the first tubes into the inner chamber. The embodiment may also include transitions between the inlet pipe and the outer chamber and the outlet pipe and the inner chamber having smooth surfaces to minimize the pressure drop as the flow of the liquid occurs; the inlet and outlet pipes have an oblong or oval configuration to reduce the pressure drop associated with the moving liquid; the first header has sensor-receiving openings which extend into the top header; the first tubes and the second tubes have one or more radially extending fins to allow for more efficient transfer of heat; the heat exchanger is a two-pass system wherein relatively cool pressurized liquid enters the inlet pipe and flows through the outer chamber of the first header into the second tubes, the liquid flows through the second tubes into the second header such that the heat generated by the radial heat source causes the temperature of the liquid to increase, the partially heated pressurized liquid is forced into the first tubes and flows into the inner chamber of the first header and out the outlet pipe, such that as the liquid flows through the first tubes, the heat generated by the radial heat source causes the temperature of the liquid to continue to increase in the first tubes at a rate greater than the increase in temperature of the second tubes; having an enhancement device is used in respective tubes of the first tubes, the enhancement device creating a water vortex in the first tubes wherein a high velocity water stream which flows through the first tubes is in contact alternately with a hot side and then a cooler side of the first tubes, wherein boiling of the water in the first tubes is prevented; and having upper baffles provided in the first header to form a four-pass heat exchanger, the upper baffles causing the liquid to flow through only half of the second tubes and first tubes at any time, wherein the liquid makes four passes through the first and second tubes; having the circumferential spacing between first tubes provides a gap allowing for the proper heating of the first tubes while allowing sufficient heat to reach the second tubes to properly heat the second tubes.

Another exemplary embodiment is directed to a heat exchanger having a radial heat source. A first header of the heat exchanger has a first chamber for receiving a liquid as the liquid enters the heat exchanger and a second chamber for receiving the liquid prior to the liquid exiting the heat exchanger. A second header is spaced from the first header. First tubes extend from the second chamber of the first header to the second header, with the first tubes being spaced proximate to the radial heat source. Second tubes extend from the first chamber of the first header to the second header, with the second tubes being spaced from the radial heat source a greater distance than the first tube. The circumferential spacing between the first tubes provides a gap allowing for the proper heating of the first tubes while allowing sufficient heat to reach the second tubes to properly heat the second tubes.

The exemplary embodiment above may further include the first header has an inlet pipe which allows liquid to flow into the first chamber of the first header from outside the first header, and an outlet pipe which extends from the second chamber of the first header to allow liquid to flow from the second chamber out of the heat exchanger; the inlet and outlet pipes have an oblong or oval configuration to reduce the pressure drop associated with the moving liquid; the first header has sensor-receiving openings which extend into the top header; the first tubes and the second tubes have radially extending fins to allow for more efficient transfer of heat; the second header has at least one lower baffle, wherein the heat exchanger is a two-pass system wherein relatively cool pressurized liquid enters the inlet pipe and flows through the outer chamber of the first header into the second tubes, the liquid flows through the second tubes into the second header such that the heat generated by the radial heat source causes the temperature of the liquid to increase, the partially heated pressurized liquid is forced into the first tubes and flows into the inner chamber of the first header and out the outlet pipe, wherein the liquid with the lowest velocity enters the second header through the second tubes proximate the lower baffle to provide for the shortest return path through the first tubes to equalize the flow rate through each first tube, wherein as the liquid flows through the first tubes, the heat generated by the radial heat source causes the temperature of the liquid to continue to increase in the first tubes at a rate greater than the increase in temperature of the second tubes; upper baffles are provided in the first header to form a four-pass heat exchanger, the upper baffles causing the liquid to flow through only half of the second tubes and first tubes at any time, wherein the liquid makes four passes through the first and second tubes; an enhancement device is used in respective tubes of the first tubes, the enhancement device creating a water vortex in the first tubes wherein a high velocity water stream which flows through the first tubes is in contact alternately with a hot side and then a cooler side of the first tubes, wherein boiling of the water in the first tubes is prevented.

Another exemplary embodiment is directed to a heat exchanger having a radial heat source. The heat exchanger has a first header through which liquid enters and exits the heat exchanger. A second header is spaced from the second header and has at least one lower baffle provided therein. First tubes extend from the first header to the second header, with the first tubes being spaced proximate to the radial heat source. An enhancement device is positioned in respective tubes of the first tubes. The enhancement device creates a water vortex in the first tubes wherein a high velocity water stream which flows through the first tubes is in contact alternately with a hot side and then a cooler side of the first tubes, wherein boiling of the water in the first tubes is prevented.

The exemplary embodiment above may further include second tubes extended from the first header to the second header, the second tubes being spaced from the radial heat source a greater distance than the first tubes; the first header comprises an inlet pipe which allows liquid to flow into the first chamber of the first header from outside the first header, and an outlet pipe which extends from the second chamber of the first header to allow liquid to flow from the second chamber out of the heat exchanger; the inlet and outlet pipes have an oblong or oval configuration to reduce the pressure drop associated with the moving liquid; the second header has at least one lower baffle; the first header has at least one upper baffle.

Most copper-fin radially-fired heat exchangers in the market today obtain increased capacity by using longer tubes or increasing the number of tubes in a single ring. Using multiple rings of tubes as described herein effectively lengthens the tube linear distance without increasing the height of the heat exchanger. Consequently, the heat exchanger is half the size of a comparable single-ring heat exchanger.

Another exemplary added benefit of multiple rings is the increased heat transfer coefficient on the gas side of the tubes. This is due to the increased velocity of the gas since the flow area is reduced because the heat exchanger is shorter. Higher efficiency with less material is achieved.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
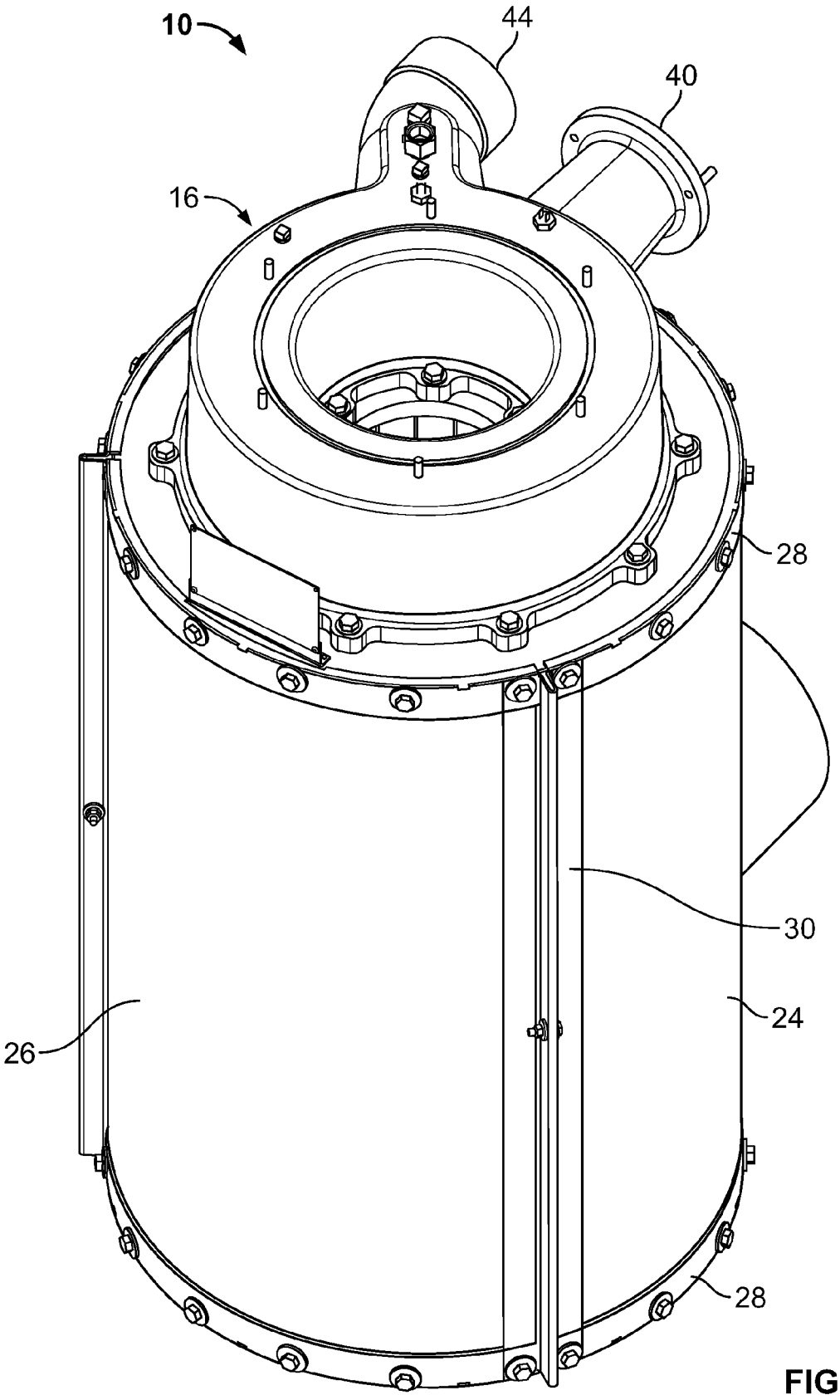
FIG. 1 is an isometric view of one embodiment of the heat exchanger assembly of the present invention, the heat exchanger being enclosed by a shell.

The radially-fired heat exchanger 10 of the present invention can be used in a gas-fired hot water boiler. In such a hot water boiler, air and fuel are pre-mixed and ignited through the radial-fired burner 8. The closed-loop heat exchanger 10 is designed for counter-flow operation to optimize heat transfer.

In general, when heat is required (as indicated by water temperature), an operating temperature control switch signals to a micro-processor-based flame safeguard programmer. The programmer energizes a blower motor and an air-flow differential pressure switch, providing a specific prepurge time. This allows the boiler to purge any residual gas.

After the purge is complete and correct air flow is established, the programmer powers an ignition transformer, and a gas pilot is spark-ignited. When the pilot flame is detected by a UV sensor, a signal is sent to the programmer which then opens both main gas valves. The main burner 8 ignites and the pilot is de-energized. Alternatively, the radially-fired heat exchanger may use direct light technology. When the desired water temperature is reached, the operating control switch opens and the programmer closes both main gas valves.

When the water temperature is reduced by the load on the system, the operating temperature control switch will close again. This sequence recycles automatically to the start of the cycle provided that the limits on water flow and gas pressure are met.

A radial-fired, fan-assisted burner 8 with a screen-type diffuser fits vertically into the circular heat exchanger 10. This vertical burner/heat exchanger 10 design produces a higher thermal efficiency than is possible with any conventional horizontal gas-fired boiler. Flame distribution is controlled by the pre-calculated free area of the screen. The fuel mixture is controlled by calibrated injection ports and an adjustable air shutter to produce a clean-burning blue flame. The burner 8 can be quickly and easily removed from the exchanger 10 for cleaning or inspection.

The radial-fired burner is designed to provide uniform radial jets of flame, the tips of which jets of flame are adjacent to but spaced apart from the innermost portions of the heat exchanger 10. The heated gases from the flames flow generally upward, primarily radially outward, but also with a component of upward flow due to heat expansion at the flames and then subsequently a downward flow after the heated exhaust gas exchanges its heat to the heat exchanger tubing such that the exhaust gases move downward along the exterior of the heat exchanger tubing 12, 14 to exhaust gases toward the lower end of the tubes and radially outward therefrom. Because of the completeness of the burning, the exhaust gases may be generally discharged with minimal impact on the environment, or, if additional purification is required by any particular governmental standards, may be further treated prior to discharge.

The centrally located burner 8 has a cylindrical burner surface, which is preferably formed of a thin sheet of pressed high-temperature metal fibers having perforations uniformly therethrough so that the forced gas and air mixture is forced out of the perforations through cylindrical burner surface where it is ignited and burns to produce heat, which is transferred to the tubes 12, 14 of the heat exchanger 10 both by convection of the heated gases and also by radiation.

The heat exchanger 10 has integral tubes 12, 14, arranged vertically with removable cylindrical headers 16, 18. This tube configuration provides a high heat transfer ratio and a fast response to load requirements. Since the tubes 12, 14 completely surround the burner 8, ambient losses are eliminated. All the hot gases are forced over the tubes, maximizing heat transfer and producing the high efficiency.

With reference to FIGS. 1 through 18, an exemplary first embodiment of the heat exchanger 10 is shown. The heat exchanger 10 has a top header 16, a bottom header 18, a first ring of tubes 12, a second ring of tubes 14, a top tube sheet 20 and a bottom tube sheet 22. As best shown in FIGS. 2 through 7, the first ring of tubes 12 and the second ring of tubes 14 extend between the top header 16 and the bottom header 18. The top tube sheet 20 and the bottom tube sheet 22 cooperate with the tubes 12, 14 to maintain the tubes 12, 14 in position relative to each other.

Figure 2:
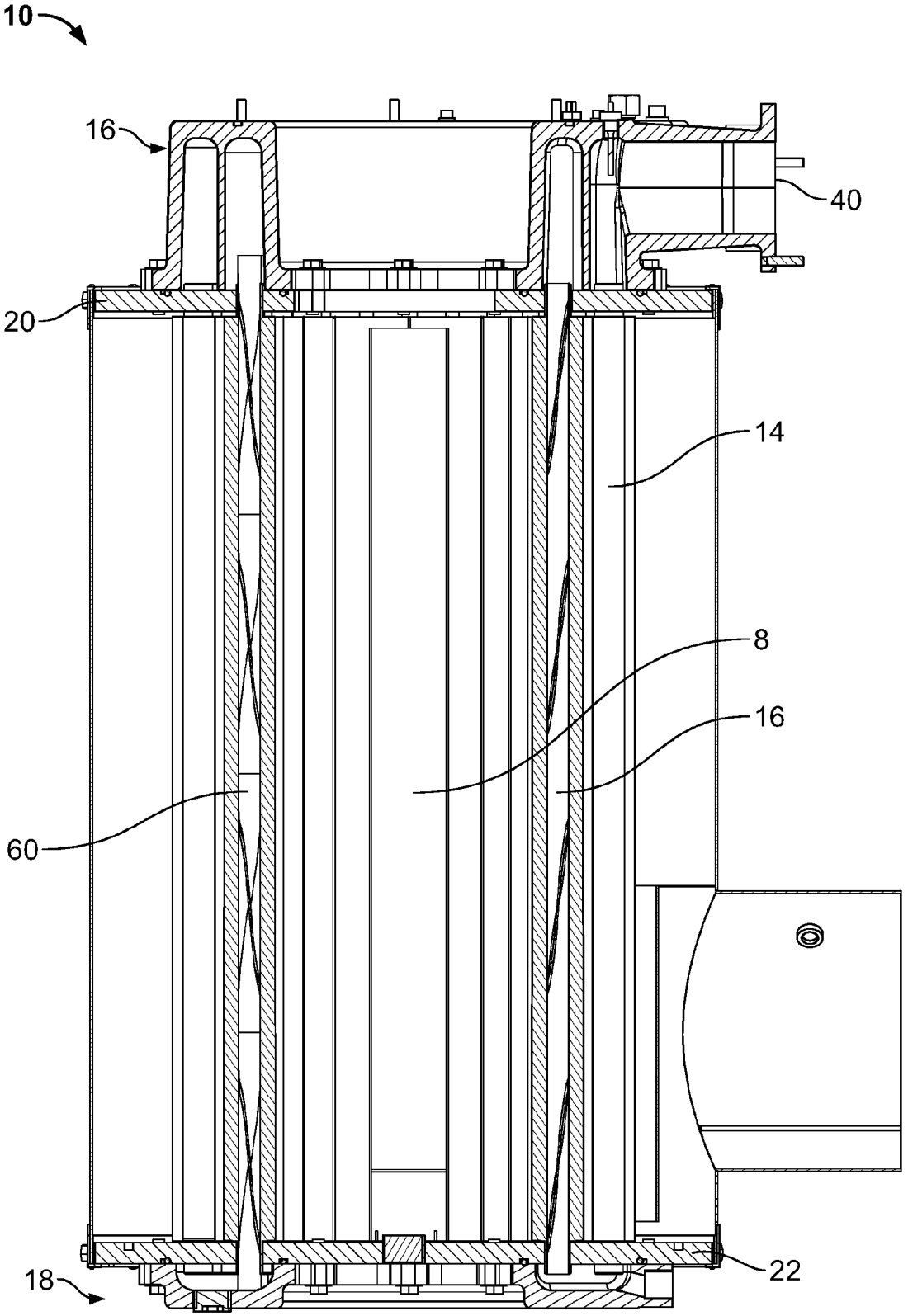
FIG. 2 is a cross-sectional view of the heat exchanger assembly of FIG. 1, taken along the line 2-2 of FIG. 1, showing finned inner tubes with enhancement device positioned therein.
Figure 3:
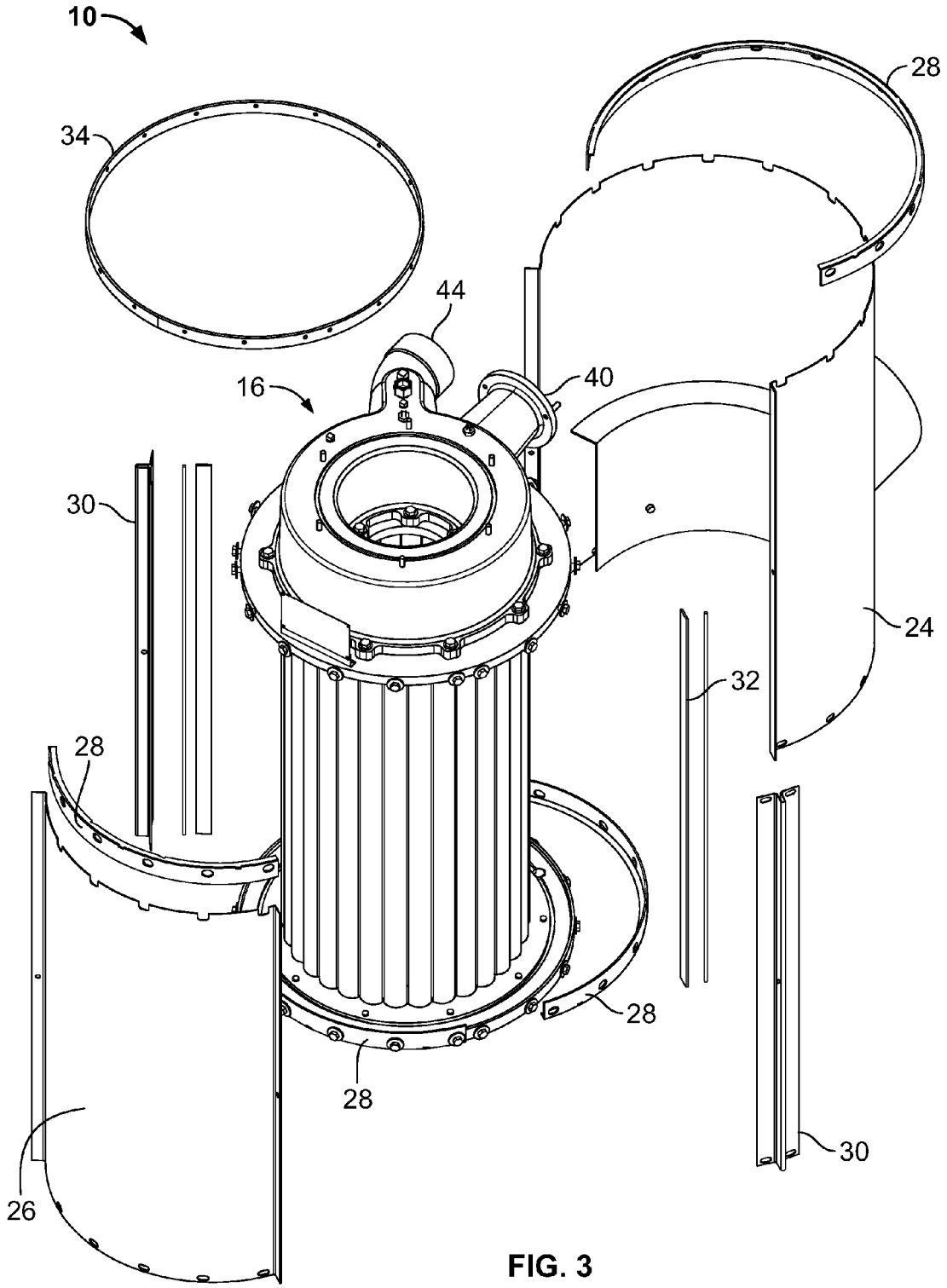
FIG. 3 is an exploded perspective view of the heat exchanger assembly of FIG. 1.
Figure 4:
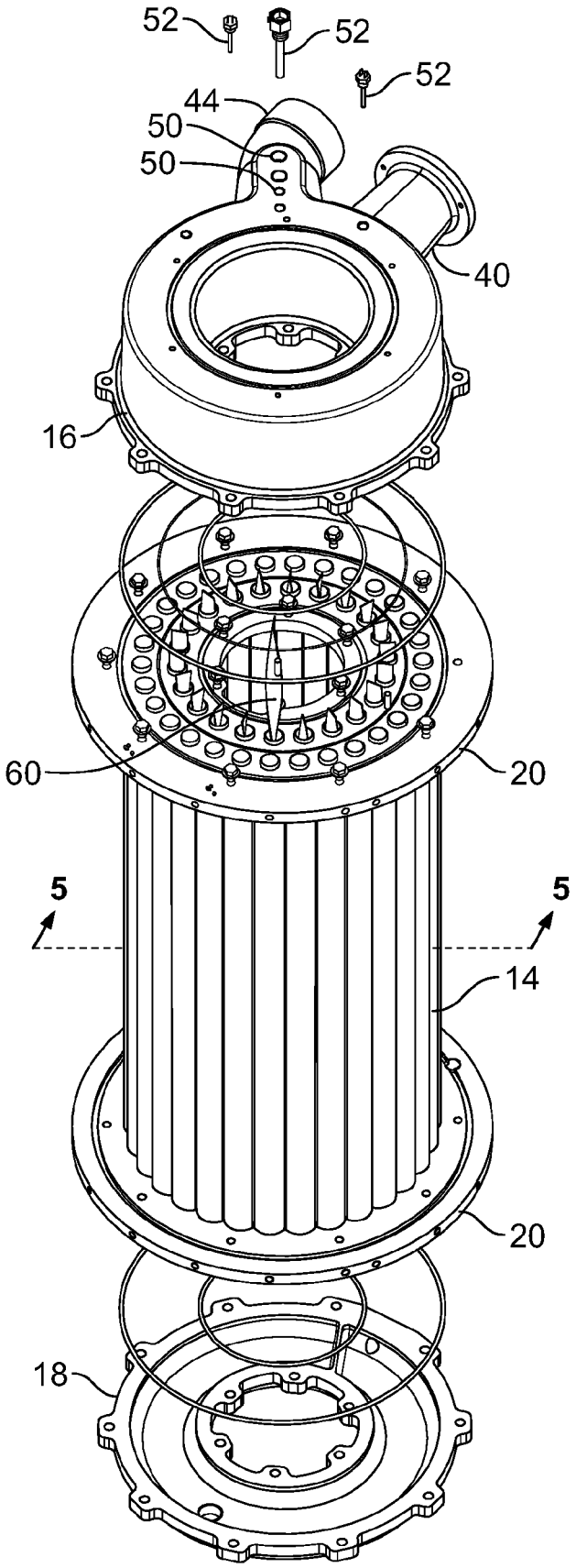
FIG. 4 is an exploded perspective view of a two-pass heat exchanger housed in the heat exchanger assembly of FIG. 1.

As best shown in FIGS. 1 through 3, shell halves 24, 26 cooperate with reinforcing/fastening ribs 28, flanges 30, gaskets 32 and gaskets 34 to encase the heat exchanger 10, thereby providing a sealed tight shell which retains the heat from the burner 8 and allows water or other liquids to flow through the headers 16, 18 and tubes 12, 14.

The exemplary heat exchanger 10 shown has two rings of tubes 12, 14 through which water or other liquid flows. In the embodiment shown, the tubes 12, 14 are made from copper, but other material having the appropriate strength and heat stability and transfer characteristics can be used, such as, but not limited to, copper nickel, aluminum, stainless steel and alloys thereof. While two rings of tubes 12, 14 are shown, any number of multiple rings may be used without departing from the scope of the invention.

The tubes 12, 14 may have radially extending fins to allow for more efficient transfer of heat. As is shown in the drawings, the tubes 12, 14 extend radially about an opening 36 in which the burner 8 is positioned. The inner tubes 12 are closer to the opening 36 and the burner 8, while the outer tubes 14 are spaced further from the opening 36. The location of the rings of tubes 12, 14 is not arbitrary, but designed to provide maximum efficiency. If the diameter D1 of the first ring is too small, the tubes 12 will be too close to the burner 8, which will cause combustion problems, i.e. high carbon monoxide (CO). It is, therefore, not desirable to have the flames of the burner 8 contact any surface of the inner tubes 12 or the outer tubes 14, but rather have the heated gases from the flames surround the tubes 12, 14, as previously described.

Figure 5:
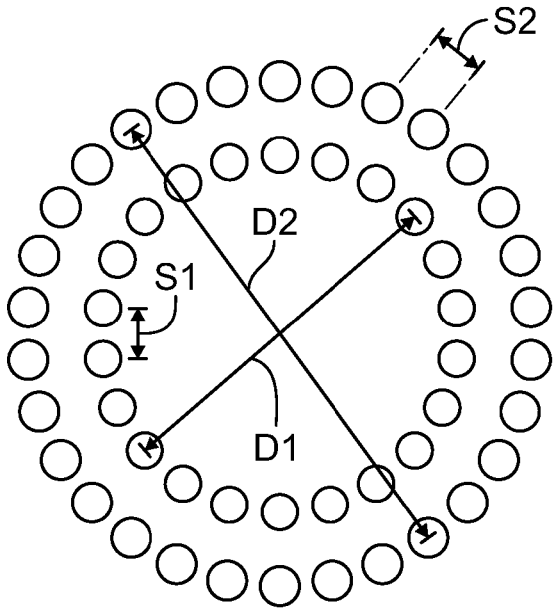
FIG. 5 is a cross-sectional view of the inner and outer tubes of the heat exchanger taken along line 5-5 of FIG. 4.
Figure 6:
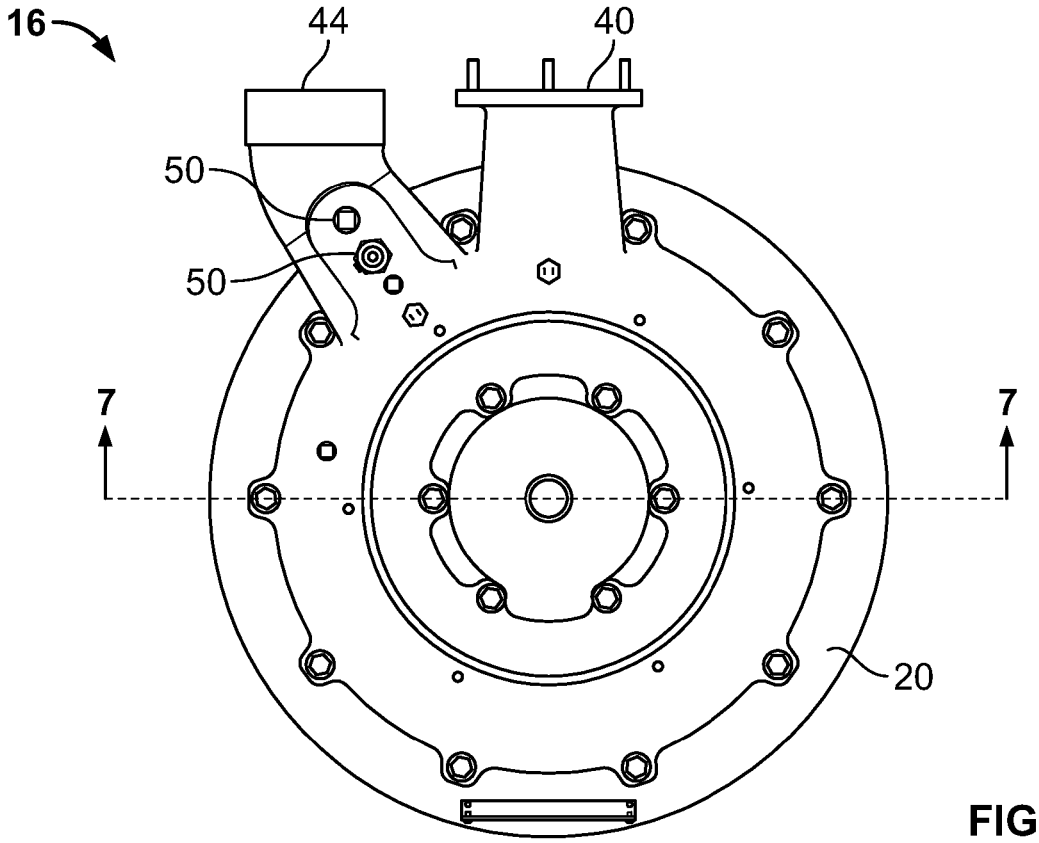
FIG. 6 is a top view of the heat exchanger of FIG. 4.
Figure 7:
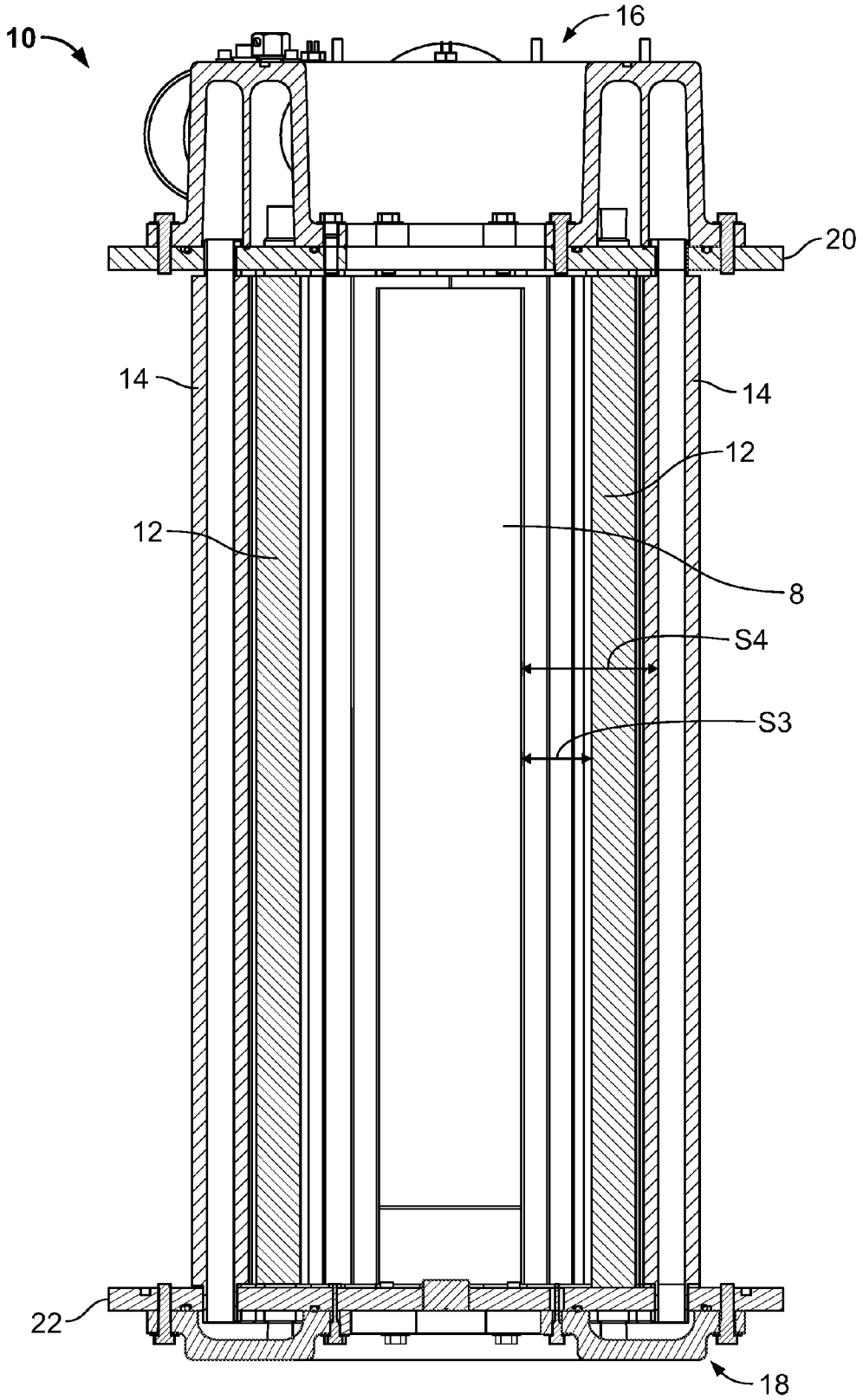
FIG. 7 is a cross-sectional view of the heat exchanger of FIG. 4, taken along the line 7-7 of FIG. 8, showing outer tubes in cross-section.
Figure 8:
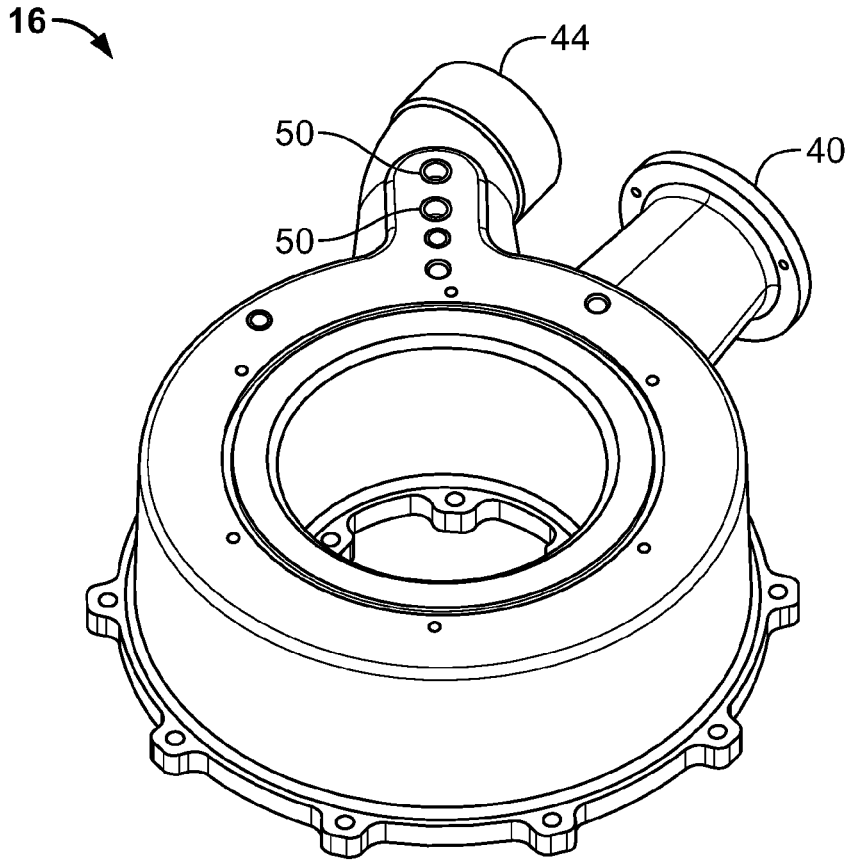
FIG. 8 is a top isometric view of a top header of the heat exchanger of FIG. 4.
Figure 9:
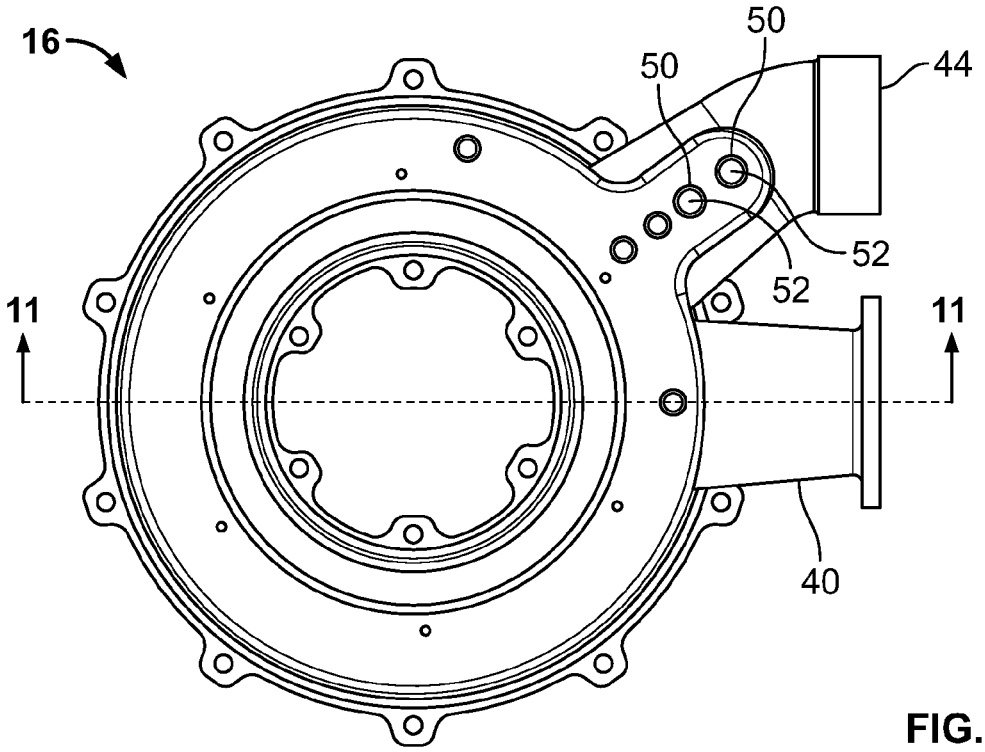
FIG. 9 is a top view of the top header of the heat exchanger of FIG. 4.
Figure 11:
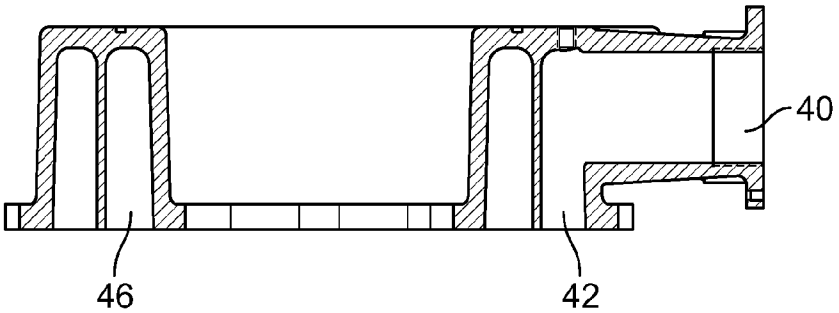
FIG. 11 is a cross-sectional view of the top header of the heat exchanger of FIG. 4, taken along the line 11-11 of FIG. 9, showing the inlet pipe and the inner and outer chambers.
Figure 12:
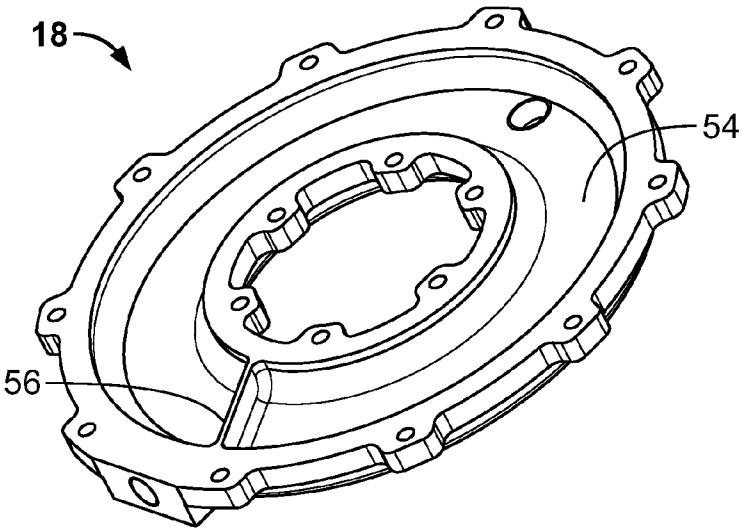
FIG. 12 is an isometric view of a bottom header of the heat exchanger of FIG. 4.
Figure 10:
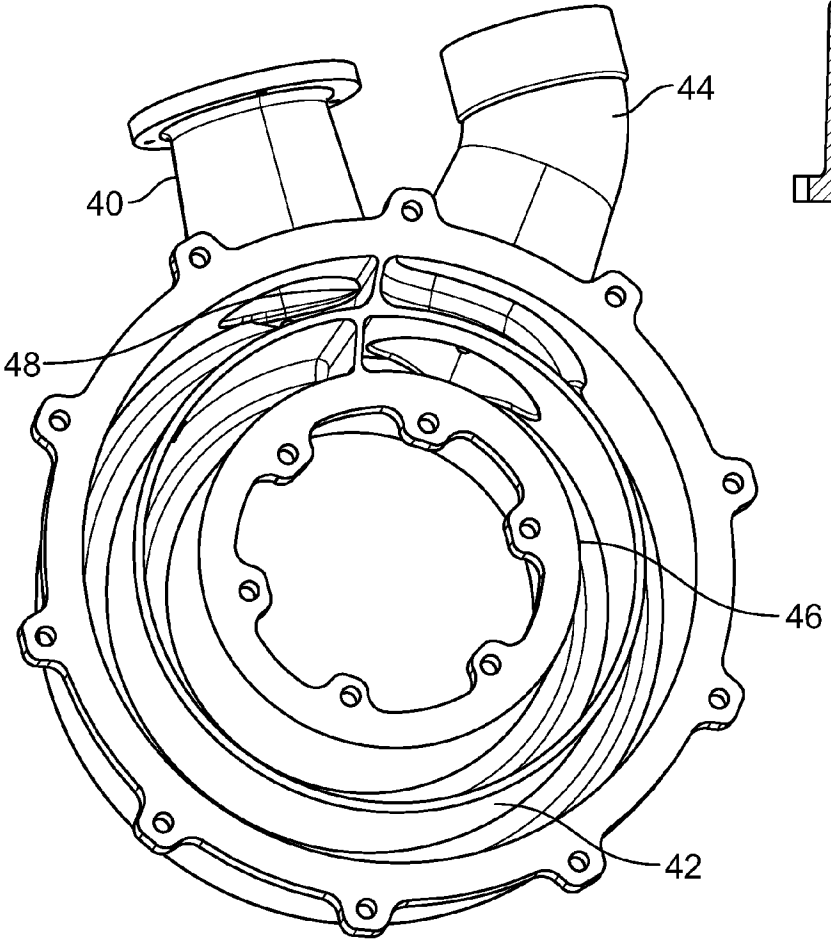
FIG. 10 is a bottom isometric view of the top header of the heat exchanger of FIG. 4, showing chambers through which the liquid flows.
Figure 13:
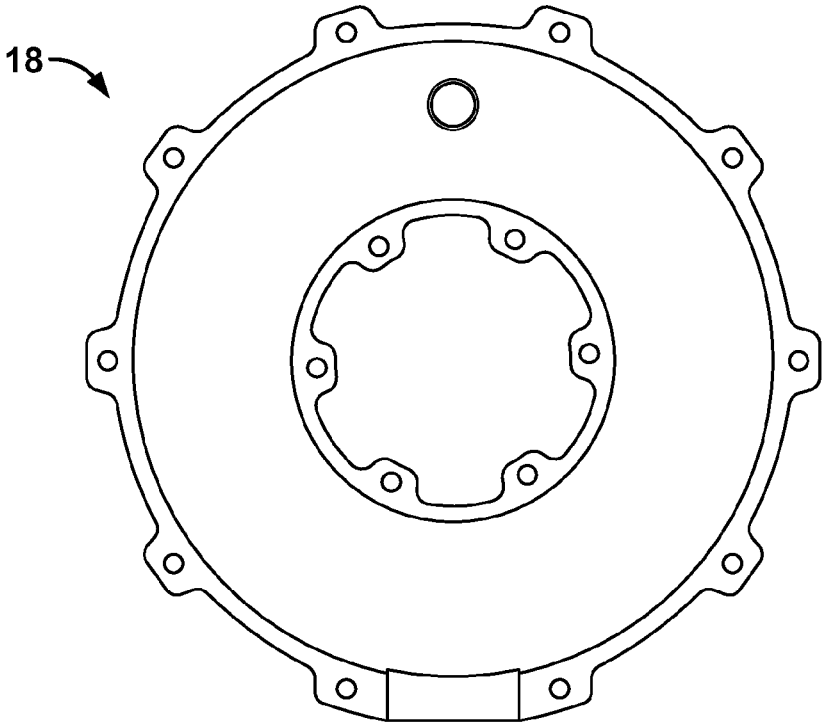
FIG. 13 is a top view of the bottom header of FIG. 12.
Figure 14:
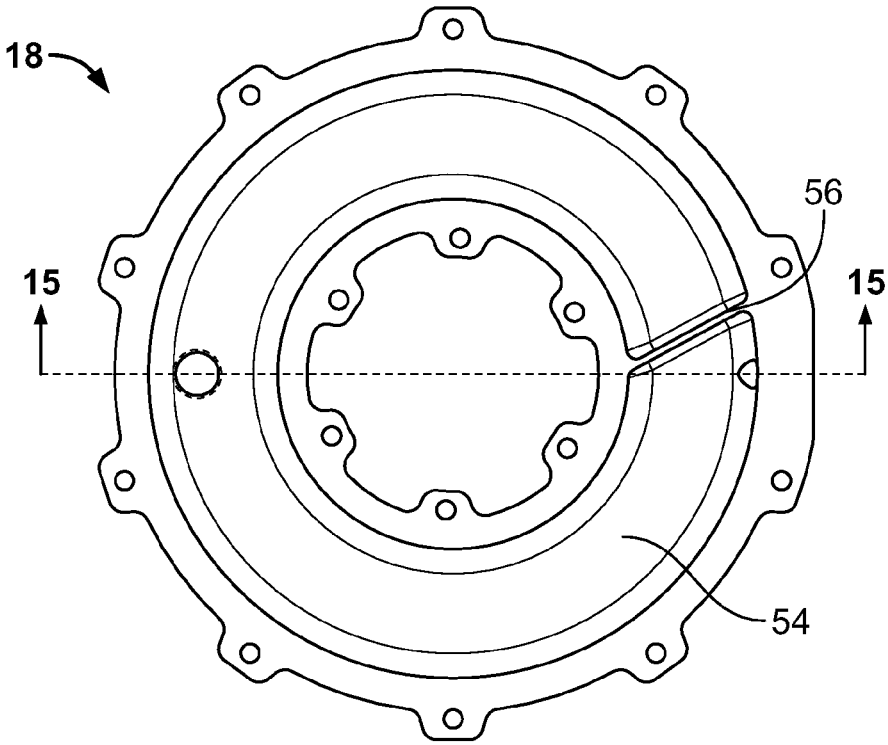
FIG. 14 is a bottom view of the bottom header of FIG. 12, showing a baffle provided therein to deflect the liquid to allow the bottom header to provide a reverse return configuration.
Figure 15:
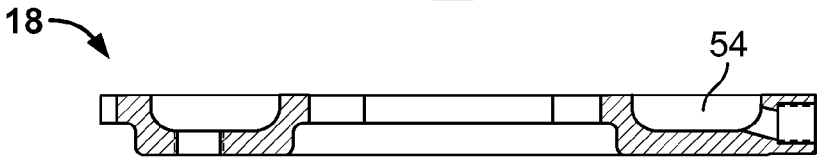
FIG. 15 is a cross-sectional view of the bottom header of the heat exchanger, taken along the line 15-15 of FIG. 14.

Referring to FIG. 5, the circumferential tube spacing S1, S2 from one tube 12, 14 to another is critical for pressure design and gas flow design. If the gap or spacing S1 between the inner tubes 12 is too wide, the inner tubes 12 would not be properly heated, resulting in an underperforming design. If the gap or spacing S1 between the inner tubes 12 is too narrow, the outer tubes 14 would not be properly heated, again resulting in an underperforming design. Stated differently, the circumferential spacing between first tubes provides a gap which allows for the proper heating of the first tubes while allowing sufficient heat to reach the second tubes to properly heat the second tubes.

Once the proper diameter D1 and proper spacing S3 (FIG. 7) of the inner tubes from the burner 8 is determined, and once the proper spacing S1 between the inner tubes 12 is determined, the number of inner tubes 12 needed can be determined, as the diameter D1 of the inner tube circle and the spacing S1 determines the number of tubes 12 in the inner ring. In addition, once the proper spacing S4 (FIG. 7) of the outer tubes 14 from the inner tubes 12 is determined, and once the proper spacing S2 between the outer tubes 14 is determined, the number of outer tubes 14 can be determined, as the diameter D2 of the outer tube circle and the spacing S2 determines the number of tubes 14 in the outer ring. The diameter D2 of the second ring of tubes is dependent upon the diameter D1 of the first ring of tubes. The circumference of each ring increases by about 3 times the diameter increase. The number of tubes provided in each additional ring is calculated using a similar method. The diameters of the inner tubes 12 and outer tubes 14 may be the same or may be different depending upon the flow characteristics required.

Figure 16:
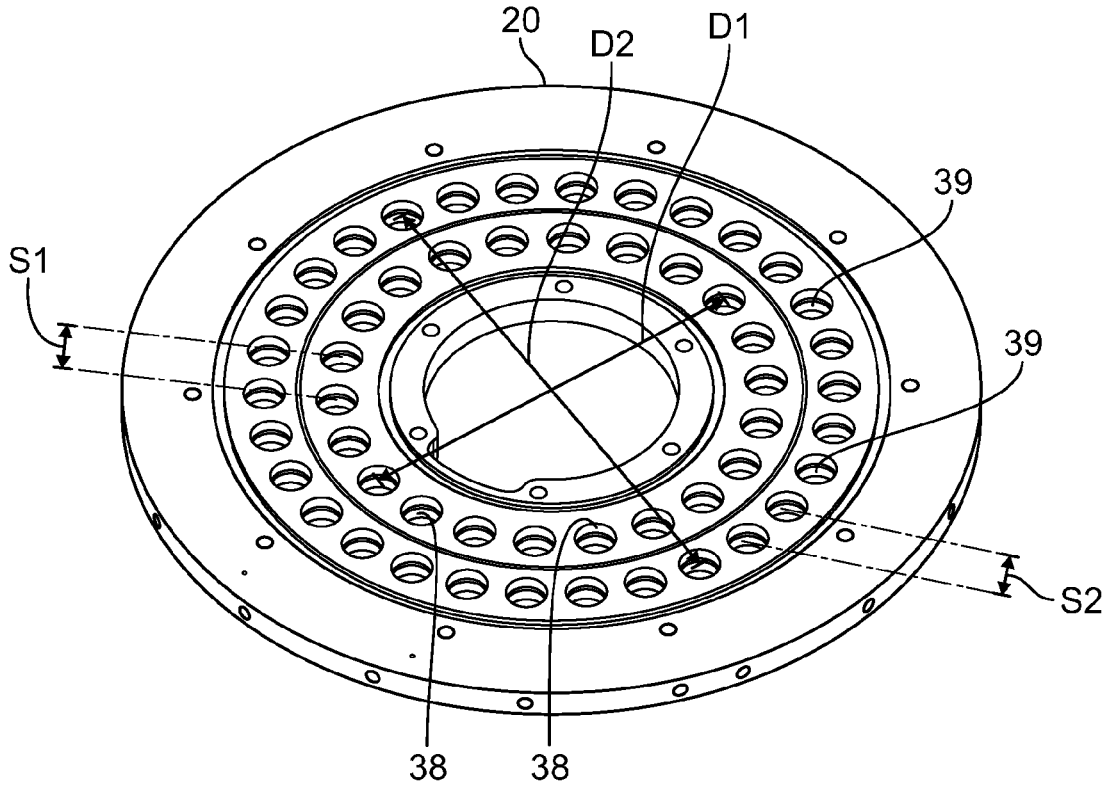
FIG. 16 is an isometric view of a top tube sheet of the heat exchanger of FIG. 4.
Figure 17:
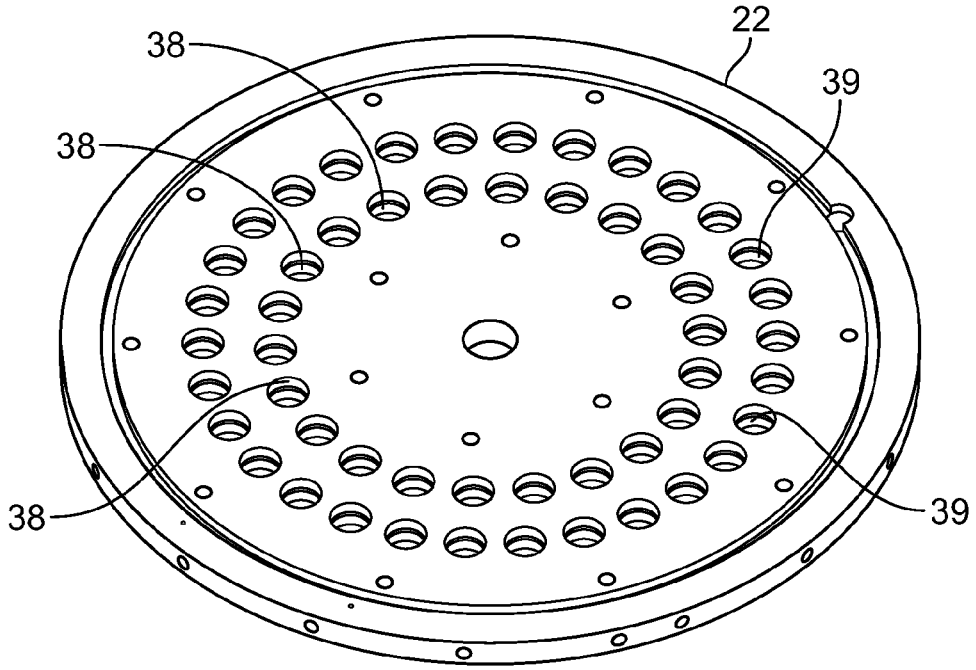
FIG. 17 is an isometric view of a bottom tube sheet of the heat exchanger of FIG. 4.

Referring to FIGS. 16 and 17, once the proper spacing is determined, openings 38, 39 are formed in the top tube sheet 20 and the bottom tube sheet 22. The openings 38, 39 are spaced to correspond to the spacing of the inner and outer tubes 12, 14. The tubes 12, 14 are inserted into the openings 38, 39 and are maintained in position relative thereto.

The number of tubes 12, 14 in each ring determines the water velocity through them. This velocity must be high enough to prevent boiling and scaling problems, but low enough to prevent erosion. Therefore, when designing a multiple-ring radially-fired heat exchanger 10, it is important to properly space the tubes 12, 14 to obtain the optimum velocity of the liquid to facilitate maximum efficiency. As more tubes 14 are provided in the second ring, the velocity of the liquid in the tubes 12, 14 becomes an issue. Consequently, the velocity in both rings must be adequate to allow for the proper heat transfer in both rings. If additional rings are provided, the system must be designed to allow for all tubes in all rings to have adequate velocity of the liquid. In the exemplary embodiment show, the optimum velocity is between 3 ft/s to 8 ft/s, although other flows are possible.

As shown in FIGS. 8 through 11, the top or upper header 16 has an inlet pipe 40 which allows liquid to flow into an outer chamber 42 of the header 16. An outlet pipe 44 extends from an inner chamber 46 to allow liquid to flow from the inner chamber 46 out of the heat exchanger 10. In the exemplary embodiment shown in FIGS. 8 through 11, the top header 16 is cast from material having the appropriate strength and heat resistant characteristics, such as, for example, cast iron. Because the top header 16 is cast, the transition 48 between the inlet pipe 40 and the outer chamber 42 and the outlet pipe 44 and the inner chamber 46 can be configured to have smooth surfaces and to optimize their geometry to reduce the pressure drop as the flow of the liquid is directed through these areas. All the surfaces of the top header 16 can be controlled to allow minimal pressure drop. In addition, as the inlet and outlet pipes 40, 44 are cast, they may be made to have an oblong or oval configuration. This configuration also reduces the pressure drop associated with the moving liquid. Each of the multiple chambers 42, 46 of the top header 16 must be configured to meet the flow requirements of the system, i.e., ensure adequate flow rate and velocity while minimizing pressure drop.

The top header 16 has openings or sensor wells 50 which extend into the outlet pipe 44 or other locations along the top header 16. The wells 50 may have sensors 52 positioned therein for sensing water temperature, water level, flow rate, or any other relevant properties. As the top header 16 is cast, the wells 50 may be molded into the outlet pipe 44 to provide a direct path for the sensors 52 to be inserted at meaningful locations of the heat exchanger 10, i.e., directly into the burner compartment.

While the top header 16 is shown as a cast, single piece, components of the top header may be manufactured as separate pieces and assembled together by welding or the like.

As shown in FIGS. 12 through 15, the bottom header 18 has a chamber 54 and a baffle 56. The bottom or lower header 18 is also cast from material having the appropriate strength and heat resistant characteristics, such as, for example, cast iron. Because the bottom header 18 is cast, all surfaces of the chamber 54 can be configured to have smooth surfaces and to optimize their geometry to reduce the pressure drop as the flow of the liquid is directed through these areas. The chamber 54 of the bottom header 18 must be configured to meet the flow requirements of the system, i.e., ensure adequate flow rate and velocity while minimizing pressure drop.

While the bottom header 18 is shown as a cast, single piece, components of the bottom header may be manufactured as separate pieces and assembled together by welding or the like.

In the embodiment shown in FIGS. 1 through 18, the heat exchanger 10 is shown as a two-pass system. Relatively cool pressurized liquid enters the inlet pipe 40 and flows through the outer chamber 42 of the top header 16 into the outer ring of finned tubes 14. The liquid is forced to flow into all of the tubes 14 of the outer ring. However, the pressure associated with the liquid entering the outer tubes 14 furthest from the inlet pipe 40 is less than the pressure associated with the liquid entering the outer tube 14 closest to the inlet pipe 40. The liquid flows through the outer tubes 14 into the bottom header 18. As the liquid flows through the outer tubes 14, the heat generated by the burner 8 causes the temperature of the liquid to increase.

Once the liquid enters the bottom header 18, the pressure of the liquid forces the liquid through the chamber 54 of the bottom header 18 and through the inner tubes 12. The baffle 56 of the bottom header 18 causes the liquid with the lowest velocity to have the shortest return path through the inner tubes 12 and the liquid with the highest velocity to have the longest return path. Because of the reverse return configuration, the flow rate through each tube 12 is equalized. The bottom header 18 is designed to provide adequate resistance to flow to prevent "short circuiting" of the flow. The path of least resistance is the return tube closest to the supply tube.

The partially heated pressurized liquid is forced into all of the tubes 12 of the inner ring. The liquid flows through the inner tubes 12 into the inner chamber 46 of the top header 16 and out the outlet pipe 44. As the liquid flows through the inner tubes 12, the heat generated by the burner 8 causes the temperature of the liquid to continue to increase. As the inner tubes 12 are closer to the burner 8, the change of temperature of the liquid in the inner tubes 12 is greater than the change of temperature of the liquid in the outer tubes 14.

Figure 18:
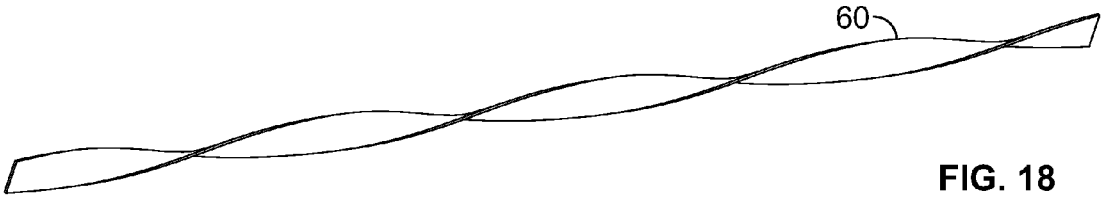
FIG. 18 is an isometric view of an enhancement device which is inserted into the inner tubes of the heat exchanger.
Figure 19:
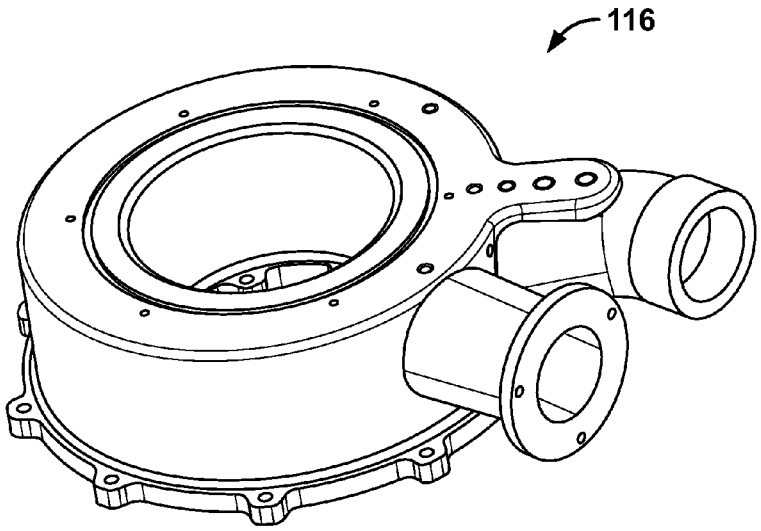
FIG. 19 is a top isometric view of an exemplary alternate top header of the heat exchanger, the alternate header having baffles to allow the liquid to make four passes through the tubes.
Figure 20:
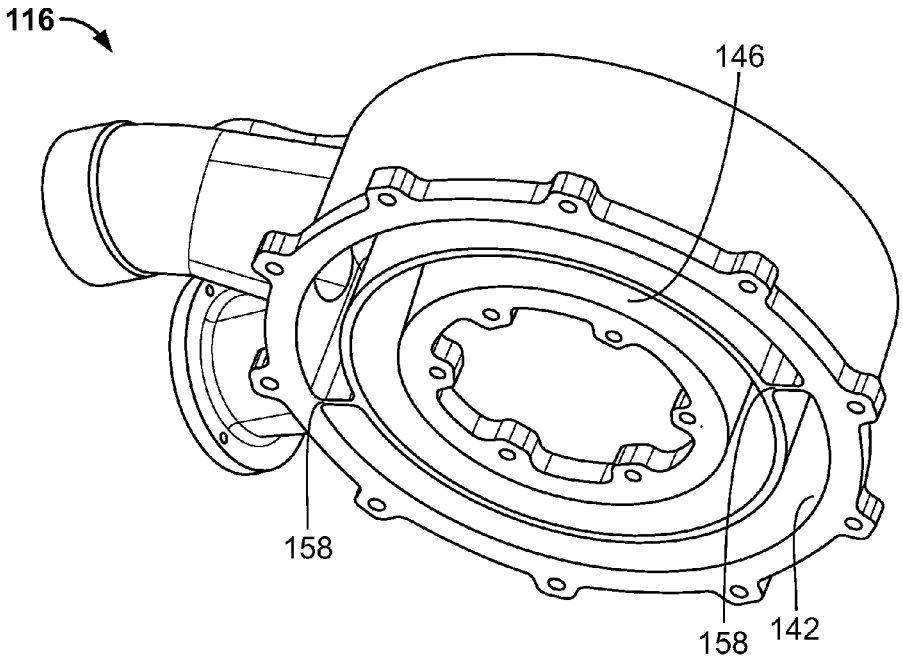
FIG. 20 is a bottom isometric view of the alternate top header of the heat exchanger, showing chambers and baffles which control the flow of the liquid.
Figure 21:
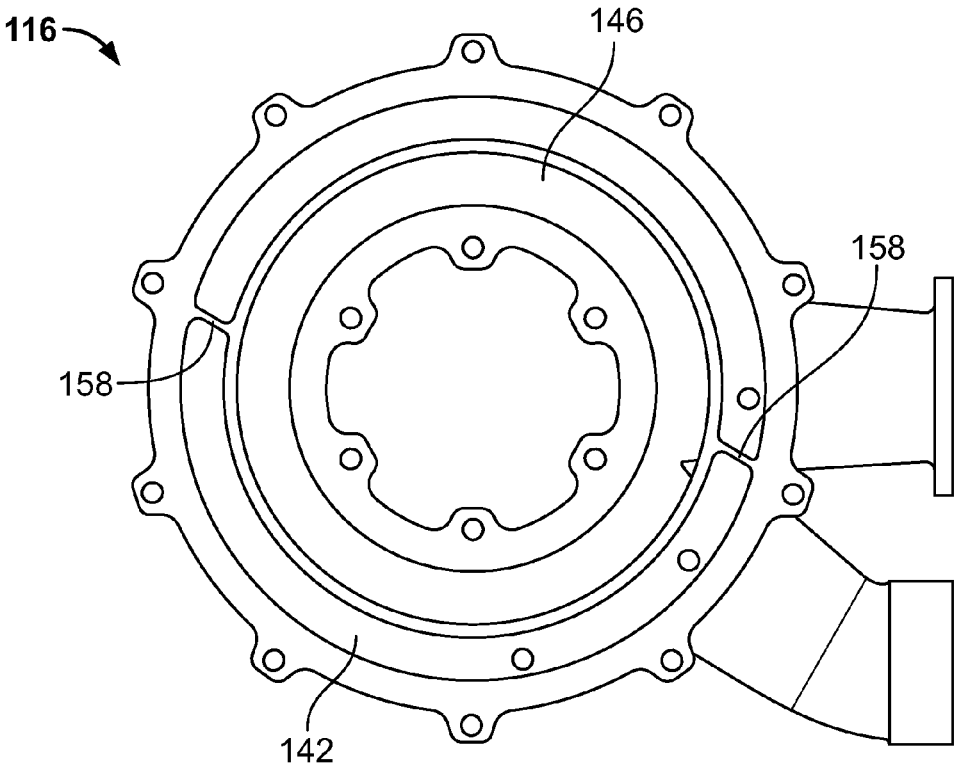
FIG. 21 is a bottom view of the alternate top header of FIG. 20.
Figure 22:
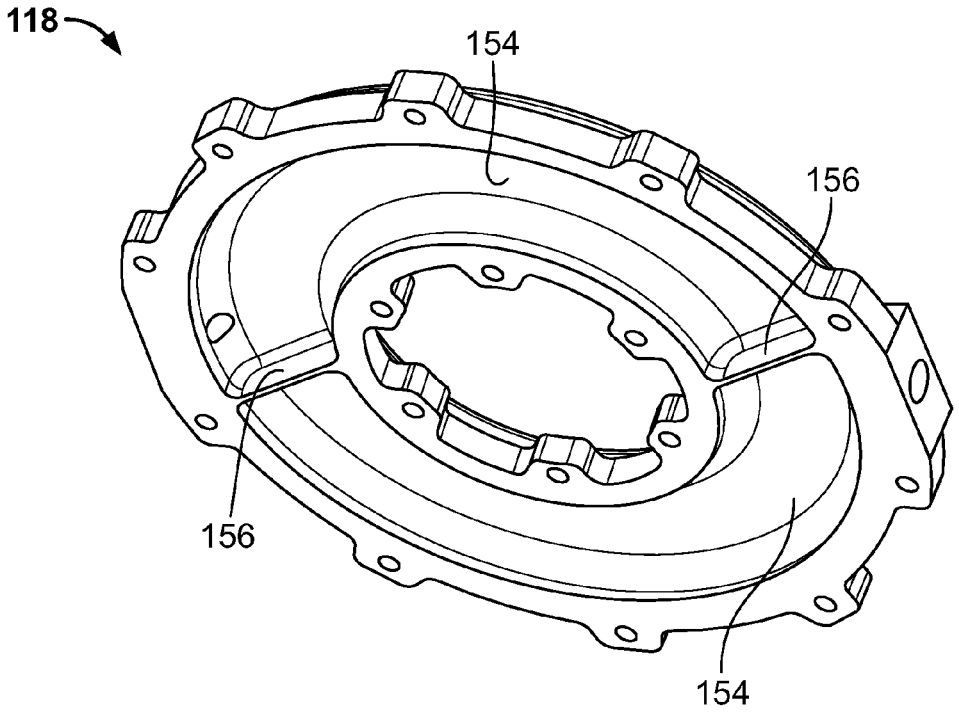
FIG. 22 is a bottom isometric view of an alternate bottom header of the heat exchanger, the alternate header having baffles to allow the liquid to make four passes through the tubes.
Figure 23:
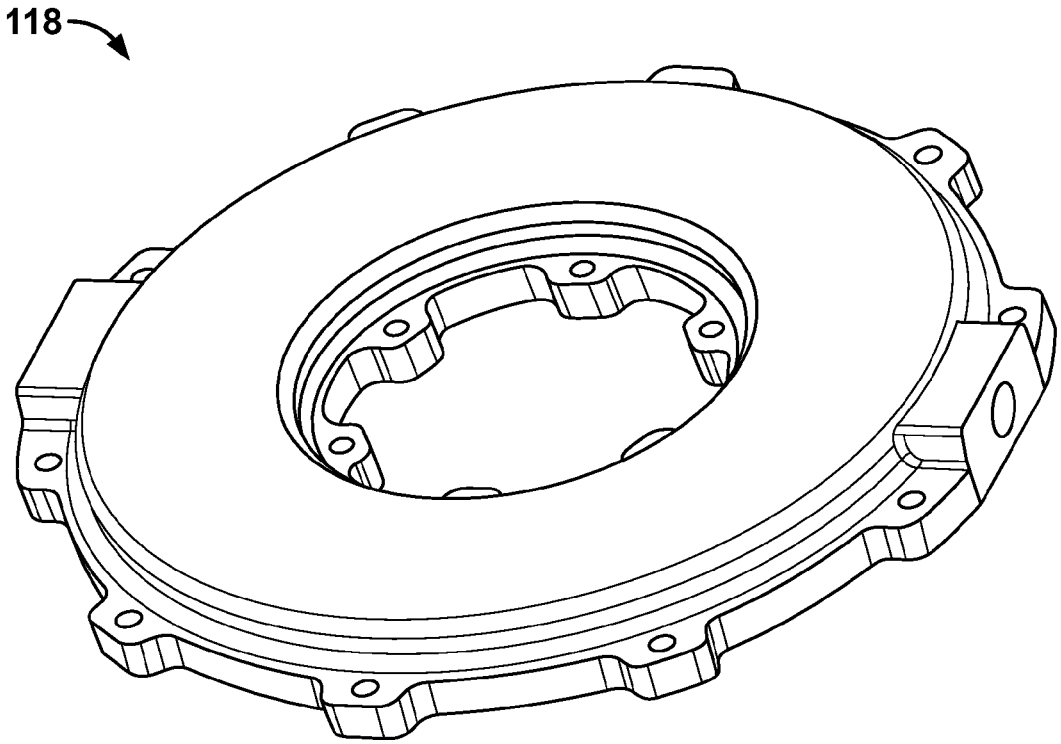
FIG. 23 is a top isometric view of the alternate bottom header of the heat exchanger.
Figure 24:
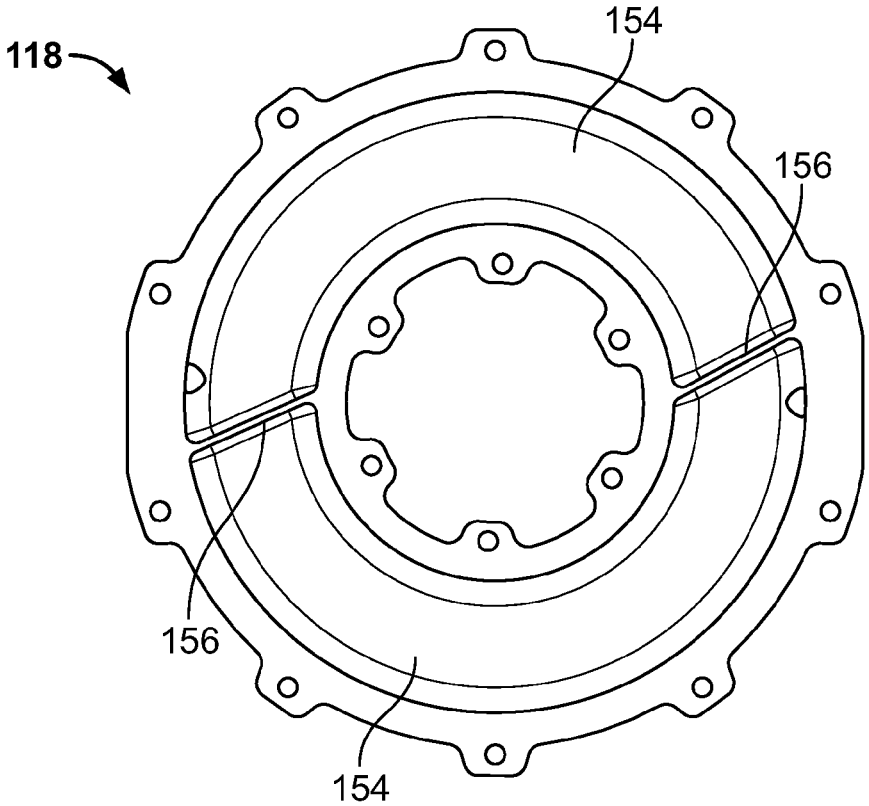
FIG. 24 is a bottom view of the alternate bottom header of FIG. 22.

As the temperature of the surfaces of the inner tubes 12 which are closer to the burner 8 can be significantly greater than the temperature of the surfaces of the inner tubes 12 away from the burner 8, it is beneficial to have a method to "mix" the liquid as it flows through the inner tubes 12. In order to accomplish this, enhancement devices 60, as best shown in FIGS. 2 and 18, are used in the inner ring of tubes 12 to create a water vortex in the tubes 12. This vortex ensures that there is a high velocity water stream in contact alternately with the hot side and then cooler side of the tube 12. This action helps to prevent boiling of the water in the inner ring of tubes 12.

Referring to FIGS. 19 through 24, an alternate exemplary embodiment of a top header 116 and bottom header 118 is shown. In this embodiment, baffles 158 are provided in the outer chamber 142 of the top header 116 and baffles 156 are provided in the chamber 146 of the bottom header 118, to convert the heat exchanger 110 from a two-pass to a four-pass. In this configuration, the inner and outer rings 112, 114 are divided in half, allowing the liquid to flow through only half of the tubes in any ring at any time. This allows the liquid to make four passes through the tubes 112, 114 rather than two as described above. Additional baffles may be added to alter the number of passes.

Most copper-fin radially-fired heat exchangers in the market today obtain increased capacity by using longer tubes or increasing the number of tubes in a single ring. Using multiple rings of tubes as described herein effectively lengthens the tube linear distance without increasing the height of the heat exchanger. Consequently, the heat exchanger 10 is half the size of a comparable single-ring heat exchanger.

An exemplary added benefit of multiple rings is the increased heat transfer coefficient on the gas side of the tubes. This is due to the increased velocity of the gas since the flow area is reduced as the heat exchanger 10 is shorter. Higher efficiency with less material is achieved.

While the invention has been described with reference to a preferred exemplary embodiment, it will be understood by those skilled in the art that various changes, alterations and modifications may be made and equivalents may be substituted for elements thereof without departing from the scope of the invention. Therefore, it is intended that the invention not be limited to the particular embodiment disclosed as the best mode contemplated for carrying out this invention, but that the invention will include all embodiments falling within the broadest interpretation of the appended claims to which the inventors are legally entitled.

The invention claimed is:

1. A heat exchanger designed to encompass a radial flow heat source, the heat exchanger comprising:

a first header having a center opening, a first circumferential chamber defined by a first inner wall and first outer wall, and a second circumferential chamber defined by a second inner wall and a second outer wall;

said first circumferential chamber in communication with an inlet pipe and said second circumferential chamber in communication with an outlet pipe; the inlet pipe and the outlet pipe each having an opening, into respective chambers, proximate to one another and of oblong or oval configuration;

the first circumferential chamber and second circumferential chamber each having therein a baffle extending from the respective first and second inner walls to the respective first and second outer walls, such that when liquid enters the first circumferential chamber by way of the inlet pipe opening liquid flow past its baffle is prevented, and when liquid flows through the second circumferential chamber to the outlet pipe opening liquid flow past its baffle is prevented;

the baffles adjacent to one another and between the inlet and outlet transitions;

a second header axially spaced from the first header, the second header comprising a bottom circumferential chamber defined by a bottom chamber inner wall and bottom chamber outer wall, having therein a bottom chamber baffle extending from the bottom chamber inner wall to the bottom chamber outer wall, such that when liquid enters the bottom circumferential chamber liquid flow past the bottom chamber baffle is prevented;

a first tube sheet and a second tube sheet each having multiple circumferentially spaced inner openings, and multiple circumferentially spaced outer openings, the first tube sheet having a first tube sheet center opening and co-acting with the first header to seal the inner and outer chambers of the first header, and the second tube sheet co-acting with the second header to seal the bottom chamber of the second header;

first tubes which extend from the second circumferential chamber to the bottom chamber through the first tube sheet multiple circumferentially spaced inner openings and second tube sheet multiple circumferentially spaced inner openings, the first tubes spaced proximate to the first tube sheet center opening; and second tubes which extend from the first circumferential chamber to the bottom chamber and through the first tube sheet and second tube sheet multiple outer openings, the second tubes spaced from the first tube sheet center opening a greater distance than the first tubes, wherein the bottom chamber baffle is positioned with respect to the first tubes and the second tubes such that when liquid flows from the second tubes into the bottom chamber it allows for the shortest return path through the first tubes to equalize the flow rate through each of the first tubes.

2. The heat exchanger of claim 1, wherein the ratio of second tubes to first tubes is greater than one.

3. The heat exchanger of claim 1, wherein the bottom chamber baffle is radially oriented relative to the position of the first circumferential chamber baffle and the second circumferential chamber baffle.

4. The heat exchanger of claim 1, wherein if liquid enters the first circumferential chamber through the inlet pipe it is caused to flow in the first circumferential chamber to the second tubes in a substantially singular circumferential direction and flow in the second chamber of the first header to the outlet pipe from the first tubes in substantially the same circumferential direction.

5. The heat exchanger of claim 1, further comprising one or more of the following:

the second header further comprises a second header center opening, and the second tube sheet further comprises a second tube sheet center opening.

6. The heat exchanger of claim 1, wherein one or more first tubes comprise an enhancement device positioned in respective tubes, the enhancement device creating a water vortex in the second tubes wherein if water flows through the first tubes a high velocity water stream contacts alternately with a hot side and then a cooler side of the first tubes, wherein boiling of the water in the first tubes is prevented.

7. The heat exchanger of claim 6, wherein the enhancement device of the one or more first tubes are extended beyond each end of the one or more first tubes.

8. The heat exchanger of claim 1, wherein the first header comprises sensor-receiving openings extended into the first header.

9. The heat exchanger of claim 8, wherein the sensor-receiving openings extend into the outlet pipe of the first header.

10. The heat exchanger of claim 1, wherein the each of the first tubes and each of the second tubes individually comprise one or more radially extending fins.

11. The heat exchanger of claim 1, wherein the diameter of the first tubes are different than the diameter of the second tubes.

12. The heat exchanger of claim 1, wherein the height of the first header is different than the height of the second header.

13. A heat exchanger designed to encompass a radial flow heat source, the heat exchanger comprising:

a removable first header having a center opening, a first circumferential chamber defined by a first inner wall and first outer wall, and a second circumferential chamber defined by a second inner wall and a second outer wall;

said first circumferential chamber in communication with an inlet pipe and said second circumferential chamber in communication with an outlet pipe; the inlet pipe and the outlet pipe each having an opening, into respective chambers, proximate to one another and of oblong or oval configuration;

the first circumferential chamber and second circumferential chamber each having therein a baffle extending from the respective first and second inner walls to the respective first and second outer walls, such that when liquid enters the first circumferential chamber by way of the inlet pipe opening liquid flow past its baffle is prevented, and when liquid flows through the second circumferential chamber to the outlet pipe opening liquid flow past its baffle is prevented;

the baffles adjacent to one another and between the inlet and outlet transitions;

a removable second header axially spaced from the removable first header, the removable second header comprising a bottom circumferential chamber defined by a bottom chamber inner wall and bottom chamber outer wall, having therein a bottom chamber baffle extending from the bottom chamber inner wall to the bottom chamber outer wall, such that when liquid enters the bottom circumferential chamber liquid flow past the bottom chamber baffle is prevented;

a first tube sheet and a second tube sheet each having multiple circumferentially spaced inner openings, and multiple circumferentially spaced outer openings, the first tube sheet having a first tube sheet center opening and co-acting with the removable first header to seal the inner and outer chambers of the removable first header, and the second tube sheet co-acting with the removable second header to seal the bottom chamber of the removable second header;

first tubes which extend from the second circumferential chamber to the bottom chamber through the first tube sheet multiple circumferentially spaced inner openings and second tube sheet multiple circumferentially spaced inner openings, the first tubes spaced proximate to the first tube sheet center opening; and second tubes which extend from the first circumferential chamber to the bottom chamber and through the first tube sheet and second tube sheet multiple outer openings, the second tubes spaced from the first tube sheet center opening a greater distance than the first tubes, wherein the bottom chamber baffle is positioned with respect to the first tubes and the second tubes such that when liquid flows from the second tubes into the bottom chamber it allows for the shortest return path through the first tubes to equalize the flow rate through each of the first tubes.

14. The heat exchanger of claim 13, wherein the ratio of first tubes to second tubes is greater than one.

15. The heat exchanger of claim 13, wherein the bottom chamber baffle is radially oriented relative to the position of the first circumferential chamber baffle and the second circumferential chamber baffle.

16. The heat exchanger of claim 13, wherein if liquid enters the first circumferential chamber through the inlet pipe it is caused to flow in the first circumferential chamber to the second tubes in a substantially singular circumferential direction and flow in the second chamber of the removable first header to the outlet pipe from the first tubes in substantially the same circumferential direction.

17. The heat exchanger of claim 13, further comprising one or more of the following:

the removable second header further comprises a second header center opening, and the second tube sheet further comprises a second tube sheet center opening.

18. The heat exchanger of claim 13, wherein one or more first tubes comprise an enhancement device positioned in respective tubes, the enhancement device creating a water vortex in the first tubes wherein if water flows through the first tubes a high velocity water stream contacts alternately with a hot side and then a cooler side of the one or more first tubes, wherein boiling of the water in the one or more first tubes is prevented.

19. The heat exchanger of claim 18, wherein the enhancement device of the one or more first tubes are extended beyond each end of the one or more first tubes.

20. The heat exchanger of claim 13, wherein the removable first header comprises sensor-receiving openings extended into the removable first header.

21. The heat exchanger of claim 13, wherein the sensor-receiving openings extend into the outlet pipe of the removable first header.

22. The heat exchanger of claim 13, wherein the each of the first tubes and each of the second tubes individually comprise one or more radially extending fins.

23. The heat exchanger of claim 13, wherein the diameter of the first tubes are different than the diameter of the second tubes.

24. The heat exchanger of claim 13, wherein the height of the removable first header is different than the height of the removable second header.

* * * * *